US006837772B1

(12) United States Patent
Luk

(10) Patent No.: US 6,837,772 B1
(45) Date of Patent: Jan. 4, 2005

(54) BREAST CUP CONSTRUCTION

(75) Inventor: Theone Luk, Kwai Chung (HK)

(73) Assignee: Regina Miracle International Limited, Hong Kong (HK)

( * ) Notice: Subject to any disclaimer, the term of this patent is extended or adjusted under 35 U.S.C. 154(b) by 0 days.

(21) Appl. No.: 10/623,440

(22) Filed: Jul. 18, 2003

(51) Int. Cl.[7] ..... A41C 3/00

(52) U.S. Cl. ..... 450/51; 450/39; 2/267

(58) Field of Search ..... 450/1, 39, 54–57, 450/90, 92, 93; 2/267, 268, 243.1, 69, 73, 78.1–78.4, 104–106, 115, 113; 264/257, 258, 291, 292, 294, 320, 321, 194, 152–155, 157–160, 163; 156/245

(56) References Cited

U.S. PATENT DOCUMENTS 2,555,177 A * 5/1951 Wilson et al. ..... 450/90
3,947,207 A * 3/1976 Magidson et al. ..... 425/398
5,154,659 A * 10/1992 Gluckin ..... 450/39
5,820,443 A * 10/1998 Burr ..... 450/40

* cited by examiner

*Primary Examiner*—Gloria M. Hale
(74) *Attorney, Agent, or Firm*—Ostrolenk, Faber, Gerb & Soffen, LLP

(57) ABSTRACT

Method of making a breast cup for a garment on a breast cup defining component of moldable material, applying a flexible covering panel of at least part of a breast cup to the convex side of the component, applying a flexible decorative panel to the concave side of the component, and removing a region of the panel assembly to expose the decorative panel to the convex end.

39 Claims, 6 Drawing Sheets

FIG. 1
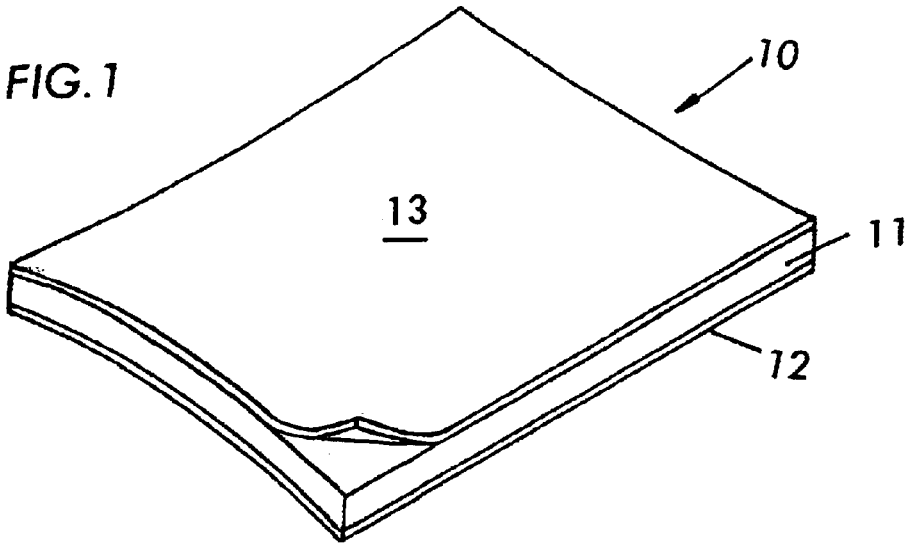
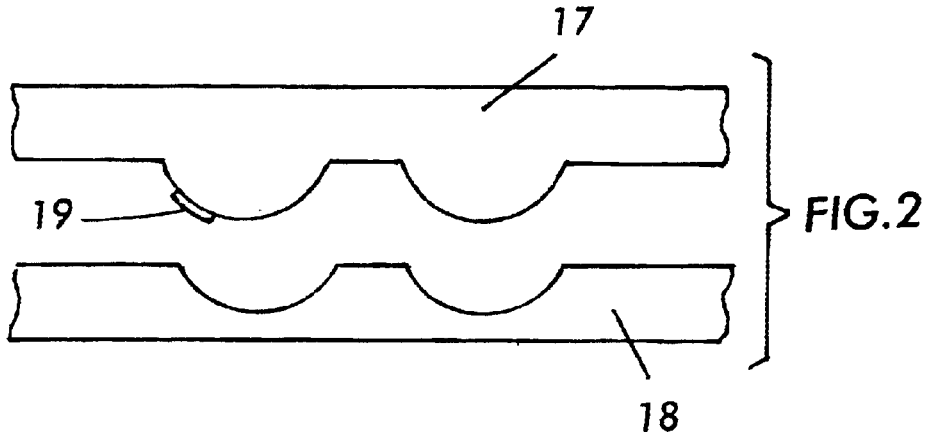
FIG. 2
FIG. 3
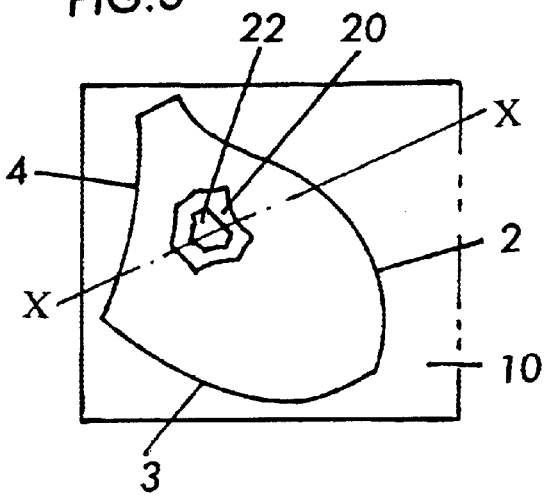
FIG. 4
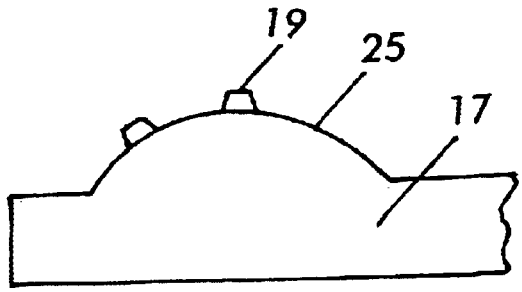

FIG.5
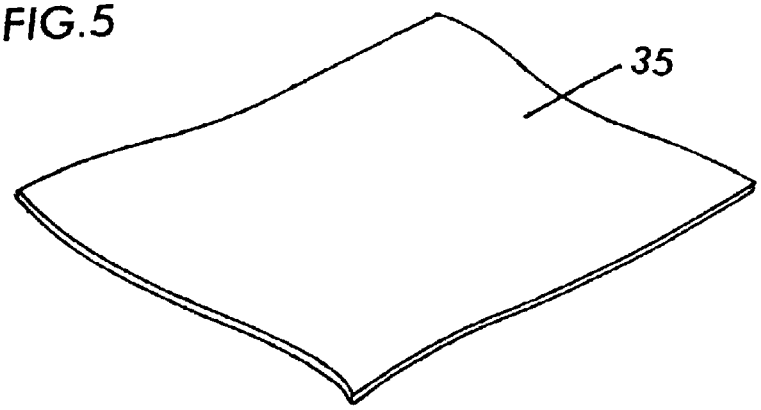
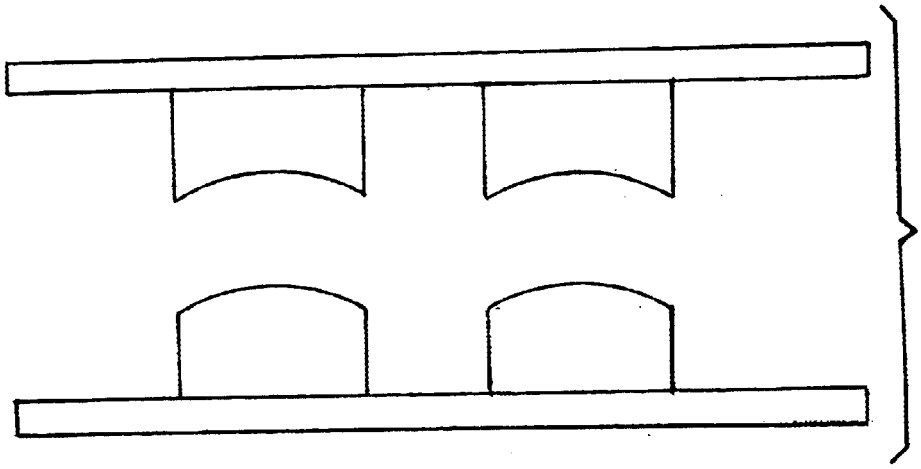
FIG.6
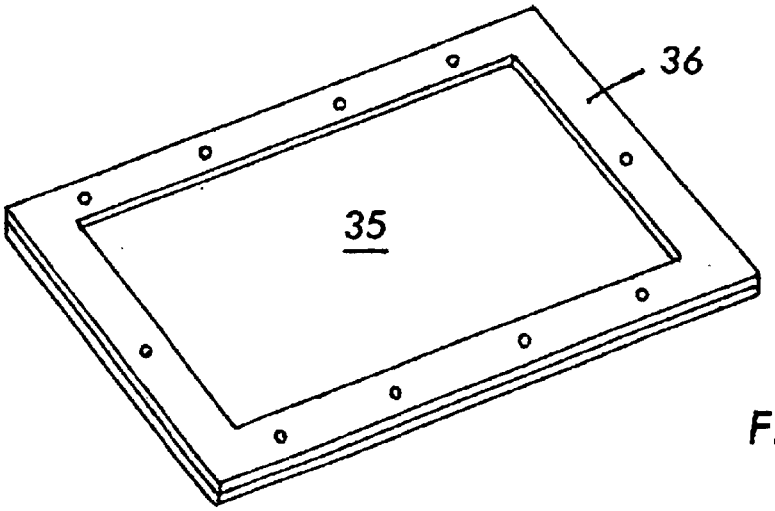
FIG.7

BREAST CUP CONSTRUCTION

FIELD OF INVENTION

The present invention relates to a method of producing a breast cup for a brassiere or other garment of clothing and in particular although not solely to a method of producing a breast cup which incorporates a panel of a contrasting appearance.

The present invention also relates to a breast cup for incorporation with other components to define a brassiere or other garment of clothing which may be defined by the methods of the present invention.

BACKGROUND

Brassieres which incorporate a breast cup construction of a molded or moldable material are becoming more prevalent. One of the advantages that is brought about by a molded breast cup construction is a more simplified method of manufacture. Normally a molded breast cup construction will reduce the number of panels required to define the breast cup since the three dimensional cup form can be formed by a molding step. Traditionally cups have been formed by the stitching of a plurality of panels together to define the three dimensional cup form.

However, the provision of a breast cup construction of a basic molded form has a reasonably plain appearance. Unlike the traditionally multi panel sewn form of cup constructions, the molded cup form generally consists of a single panel of material and in general does not incorporate significant detailing to enhance the appearance of the breast cup. Furthermore since the breast cup is of a molded construction it can be difficult to add any enhancements to the breast cup construction after it has been formed. Furthermore, prior to forming, the pre form sheet materials do not conveniently lend themselves to the addition of enhancements which can, along with the pre form, be conveniently molded to define a suitable breast cup shape.

The traditional form of sewn panel breast cup constructions have incorporated panels of contrasting appearance. In particular such traditional breast cups have included a panel or panels of lace material incorporated with a silk or other general coverage material defining the breast cup construction.

Accordingly it is an object of the present invention to provide a method of producing a breast cup assembly and in particular although not solely to a method of producing a breast cup assembly which can conveniently incorporate a panel of contrasting appearance to thereby enhance the outward appearance of the breast cup assembly or which will at least provide the public with a useful choice.

BRIEF DESCRIPTION OF THE INVENTION

In a first aspect the present invention consist in a method of making a breast cup for a garment of clothing comprising:— a) taking a structure defining component of a breast cup form and created from a flexible sheet of moldable material, b) engaging a flexible covering panel of an at least part breast cup form corresponding to at least part of said structure defining component, to the structure defining component to locate said covering panel on the convex side of the breast cup form of said structure defining component in at least a partial overlapping condition, to thereby define a panel assembly which includes said structure defining component and said covering panel c) affixing to the convex side of said panel assembly, a panel of flexible decorative material of a contrasting appearance to the convex side of said covering panel in an overlying condition to part of said panel assembly and in a position to locate said decorative panel inwardly of the perimeter of said panel assembly, d) removing a region of the panel assembly covered by and within the perimeter of said decorative panel to thereby expose the decorative panel to the concave side of said panel assembly.

Preferably said affixing defined in step (c) is by affixing said decorative panel at its perimeter to said panel assembly at and about the perimeter of said decorative panel wherein said removing defined in step (d) is of a region of said panel assembly encompassed by the perimeter fixing of said decorative panel.

Preferably said affixing defined in step (c) is by stitching said decorative panel at its perimeter to said panel assembly at and about the perimeter of said decorative panel wherein said removing defined in step (d) is of a region encompassed by the perimeter stitching of said decorative panel.

Preferably said structure defining component includes a means defining a visible reference point within the perimeter of said breast cup form wherein subsequent to step (b) and prior to step (c), said reference point is relied upon to generate a visible reference point of corresponding position visible from the convex side of said panel assembly for the purposes of reliance in step (c) to establish the appropriate said position of said decorative panel with respect to said panel assembly.

Preferably said visible reference point on said convex side of said panel assembly is generated by penetrating said panel assembly from said concave side to said convex side with a means visible.

Preferably said penetrating is by stitching a line of thread through said panel assembly.

Preferably said means defining a visible reference point is a line of reference, said stitching being along at least part of such said line.

Preferably said means defining a visible reference point is an endless line of reference provided about a region of said panel assembly said stitching being along said endless line, said region being of a perimeter shape commensurate with the perimeter shape of said decorative panel to thereby allow said decorative panel to be aligned with said stitching for the subsequent affixing defined in step (c).

Preferably means defining a visible reference point is generated during the forming of said structure defining component prior to step (a).

Preferably said means defining a visible reference point is generated during the forming of said structure defining component prior to step (a) by embossing the visible reference point into the convex side surface of said structure defining component.

Preferably said structure defining component includes a sheet of foam material and said embossing is achieved by the enhanced compression of said sheet of foam material at where said visible reference point is defined during the forming of said structure defining component.

Preferably said structure defining component includes a sheet of foam material with which there is adhered from at least one major surface thereof a sheet of fabric material, said engaging of said structure defining component with said covering panel being to position said covering panel on the side of said structure defining component opposite to said at least one sheet of fabric material.

Preferably subsequent to step (d) embroidery stitching is applied at or proximate and inward of the perimeter of said decorative panel to capture within the enclosure of said embroidery stitching the edges of said panel assembly exposed by the removing of said region defined as step (d).

Preferably said embroidery stitching also captures within the enclosure of said embroidery stitching the perimeter edge of said decorative panel.

Preferably said engaging defined in step (b) is by affixing by sewing of the covering panel to said structure defining component at the perimeter of said covering panel.

Preferably where said covering panel is of coextensive perimeter shape to the structure defining component, said engaging defined in step (b) is by affixing by sewing of the covering panel to structure defining component at the perimeter of said structure defining component.

In a further aspect the present invention consist in a method of making a breast cup for a garment of clothing comprising:— a) taking a structure defining component of a breast cup form and created from a flexible sheet of moldable material, b) engaging a flexible panel (herein after "covering panel") of an at least part breast cup form corresponding to at least part of said structure defining component, to the structure defining component to locate said covering panel on the convex side of the breast cup form of said structure defining component in at least a partial overlapping condition, to define a panel assembly which includes said structure defining component and said covering panel c) affixing to the concave side of said panel assembly, a panel of flexible material (herein after "decorative panel") of a contrasting appearance to the convex side of said covering panel in an overlying condition to part of said panel assembly and in a position to locate said decorative panel inwardly of the perimeter of said panel assembly, d) removing a region of the panel assembly covered by and within the perimeter of said decorative panel to thereby expose the decorative panel to the convex side of said panel assembly.

In a further aspect the present invention consist in a breast cup assembly comprising a structure defining component of a breast cup form and created from a flexible sheet of moldable material, a flexible panel (herein after "covering panel") affixed to said structure defining component and of an at least part breast cup form corresponding to at least part of said structure defining component, said covering panel located adjacent the structure defining component on the convex side of said structure defining component and in an at least a partial overlapping condition with said structure defining component, to define a panel assembly which includes said structure defining component and said covering panel a panel of flexible material (herein after "decorative panel") of a contrasting appearance to the convex side of said panel assembly and affixed with, at either one side selected from said convex side and concave side, said panel assembly in an overlying condition and located in a position inwardly of the perimeter of said panel assembly, wherein an opening is provided through said structure defining component at a region of the structure defining component encompassed by the perimeter of said decorative panel to there through expose the decorative panel to the opposite of said one of said convex side and concave side of said structure defining component.

Preferably said structure defining component includes a moulded sheet of foam material.

Preferably said structure defining component includes a moulded molded sheet of foam material with which there is affixed to each opposed major surface, a panel of fabric.

Preferably said decorative panel is affixed to the convex side of said panel assembly by stitching extending through said decorative panel and said panel assembly and provided at or immediately inwardly of the perimeter of said decorative panel and wherein the said or a stitching at the perimeter of said decorative panel is of an embroidery kind and captures within such stitching the perimeter edge of said decorative panel.

Preferably said structure defining component and said covering panel are coextensive.

Preferably said covering panel is a flexible fabric material.

Preferably said decorative panel is a lace material.

Preferably said structure defining component and said covering panel are coextensive and are stitched to each other at the perimeter of said cup and at where said perimeter of said decorative panel is affixed to said panel assembly.

In a further aspect the present invention consist in a method of making a breast cup for a garment of clothing comprising:— a) taking a structure defining component of a breast cup form and created from a flexible sheet of molded material, b) affixing at a convex side region and in an overlying condition to said structure defining component, a panel of flexible material (herein after "decorative panel") of a contrasting appearance to the convex side of said structure defining component, said affixing being of a position to locate said decorative panel inwardly of the perimeter of said structure defining component, c) removing a region of said structure defining component to create an opening through said structure defining component, said opening of a region corresponding to and inwardly of the perimeter of said decorative panel to thereby expose the affixed decorative panel to the concave side of said structure defining component.

Preferably said affixing defined in step (b) is or includes affixing of at least part of the perimeter of said decorative panel with said structure defining component, said removing to create said opening being by cutting said structure defining component at a region inwardly of the perimeter of said decorative panel.

Preferably said removing to create said opening in said region of said structure defining component is such that once said region is removed, said opening remains covered by said decorative panel Preferably prior the affixing as described in step (b), a flexible covering panel of an at least part breast cup form corresponding to at least part of said structure defining component, is engaged to said structure defining component to locate said flexible covering panel on the convex side of the breast cup form of said structure defining component in at least a partial overlapping condition with the convex side surface of said structure defining component, said flexible covering thereby forming part of the structure defining component.

In a further aspect the present invention consist in a method of making a breast cup for a garment of clothing comprising:— a) taking a structure defining component of a breast cup form and created from a flexible sheet of molded material, b) affixing at a concave side region and in an overlying condition to said structure defining component, a panel of flexible material (herein after "decorative panel") of a contrasting appearance to the convex side of said structure defining component, said affixing being of a position to locate said decorative panel inwardly of the perimeter of said structure defining component, c) removing a region of said structure defining component to create an opening through said structure defining component, said opening being inwardly of the perimeter of said decorative panel to thereby expose the affixed decorative panel to the convex side of said panel assembly.

Preferably said affixing described in step (b) is or includes affixing of at least part of the perimeter of said decorative panel with said structure defining component, said removing to create said opening being by cutting said structure defining component at a region corresponding to and being inwardly of the perimeter of said decorative panel.

Preferably said removing to create said opening in a region of said structure defining component is such that once said region is removed, said opening remains covered by said decorative panel Preferably a flexible covering panel of an at least part breast cup form corresponding to at least part of said structure defining component, is engaged to said structure defining component to locate said flexible covering panel on the convex side of the breast cup form of said structure defining component in at least a partial overlapping condition with the convex side surface of said structure defining component, said flexible covering thereby forming part of the structure defining component.

Preferably said flexible covering panel is affixing prior to the step described as step (b).

In a further aspect the present invention consist in a breast cup assembly comprising a structure defining component of a breast cup form and created from a flexible sheet of moldable material, a panel of flexible material (herein after "decorative panel") of a contrasting appearance to the convex side of said structure defining component affixed with, at either one side selected from said convex side and concave side, said structure defining component in an overlying condition and located in a position inwardly of the perimeter of said structure defining component, wherein an opening is provided through said structure defining component at a region of the structure defining component encompassed by the perimeter of said decorative panel to there through expose the decorative panel to the opposite of said one of said convex side and concave side of said structure defining component.

Preferably said structure defining component includes a flexible covering ply of material disposed to the convex side of said structure defining component and against which said decorative panel is engaged.

In a further aspect the present invention consist in method of making a breast cup for a garment of clothing comprising:— a) taking a structure defining component of a breast cup form and created from a flexible sheet of moldable material, b) engaging a flexible panel (herein after "covering panel") of an at least part breast cup form corresponding to at least part of said structure defining component, to the structure defining component to locate said covering panel on the convex side of the breast cup form of said structure defining component in at least a partial overlapping condition, to thereby define a panel assembly which includes said structure defining component and said covering panel, said covering panel including on the convex side of said covering panel, a panel of flexible material (herein after "decorative panel") of a contrasting appearance to the convex side of said covering panel, positioned in an overlying condition to said covering panel and in a position to locate said decorative panel inwardly of the perimeter of said covering panel, c) removing a region of the panel assembly within a corresponding region of said panel assembly encompassed by the perimeter of said decorative panel to thereby expose the decorative panel to the concave side of said panel assembly.

In a further aspect the present invention consist in a method of making a breast cup for a garment of clothing comprising:— a) taking a structure defining component of a breast cup form and created from a flexible sheet of moldable material, b) engaging a flexible panel (herein after "covering panel") of an at least part breast cup form corresponding to at least part of said structure defining component, to the structure defining component to locate said covering panel on the concave side of the breast cup form of said structure defining component in at least a partial overlapping condition, to thereby define a panel assembly which includes said structure defining component and said covering panel, said covering panel including on the concave of said covering panel, a panel of flexible material (herein after "decorative panel") of a contrasting appearance to the convex side of said structure defining component, positioned in an overlying condition to said covering panel and in a position to locate said decorative panel inwardly of the perimeter of said covering panel, c) removing a region of the panel assembly within a corresponding region of said panel assembly encompassed by the perimeter of said decorative panel to thereby expose the decorative panel to the concave side of said panel assembly.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

FIGS. 1–14 illustrate the preferred steps to the method of the invention for defining the breast cup construction of FIG. 15, wherein FIG. 1 is a perspective view of a sheet of material to provide the structure defining component of the breast cup construction prior to being mid molded, FIG. 2 is a side sectional view of a molding device to mold two cup forms in the sheet of FIG. 1, FIG. 3 is a plan view of part of the sheet of FIG. 1 after molding in the molding device of FIG. 2, FIG. 4 is a detailed side sectional view of the upper mold portion of the mold of FIG. 2, FIG. 5 is a perspective view of a cover sheet to be incorporated with the structure defining breast cup portions, FIG. 6 is a side view of a molding device for molding a breast cup form in the sheet of material of FIG. 5, FIG. 7 is a perspective view of the sheet of FIG. 5 engaged with a framing device which may be utilized for supporting the sheet of FIG. 5 during the molding phase provided by the molding device of FIG. 6, FIG. 8 is a plan view of the molded form of FIG. 1 wherein the molded cup forms are to be cut from the remaining portions of the sheet, FIG. 9 is a sectional view through a breast cup construction assembly comprising of the structure defining breast cup component and the breast cup component defined from the sheet of FIG. 5 engaged together, FIG. 10 illustrates a sewing of the structure defining breast cup component and the breast cup defined from FIG. 5 together to define an outline by stitching on the convex side of the breast cup assembly, FIG. 11 illustrates the sewing of a panel of contrasting appearance on to the convex side of the breast cup assembly, FIG. 12 is a front view of the breast cup assembly defined by the step of FIG. 11, FIG. 13 illustrates the removal of a region of the breast cup assembly to thereby expose the panel of contrasting appearance on the concave side, FIG. 14 illustrates an embroidery step for enhancing the appearance of the breast cup assembly, but which may have alternatively been previously defined with reference to the step of FIG. 11.

DETAILED DESCRIPTION OF THE INVENTION

Figure 15:
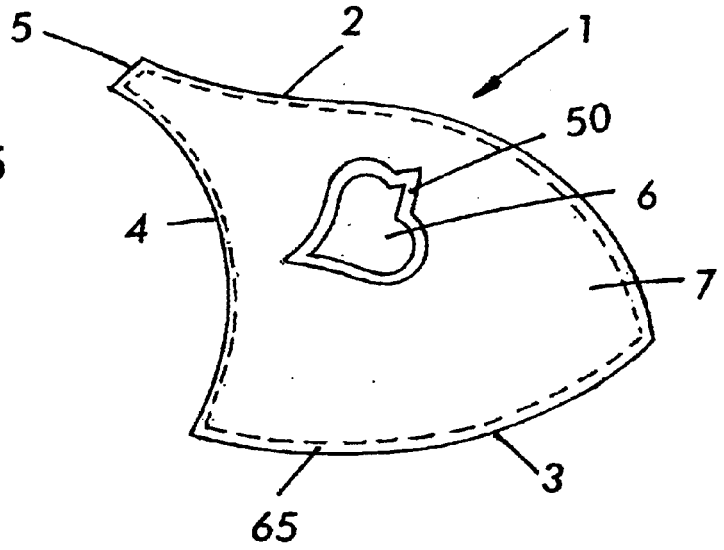
FIG. 15 is a front view of a breast cup construction of the present invention, FIG. 15A which is a brassiere which incorporates breast cup constructions as defined with reference to FIG. 15.

With reference to FIG. 15, the present invention includes a method to define a breast cup assembly similar to the kind as shown in FIG. 15. The breast cup assembly 1 is substantially of a breast cup shape and made substantially from moldable materials.

The breast cup assembly includes a three dimensional body form bounded by a neckline perimeter region 2, a base perimeter region 3 and an underarm perimeter region 4. At or proximate to the junction between the neckline perimeter region 2 and underarm perimeter region 4 at point 5, will be where the breast cup assembly 1 will be incorporated with the strap of the bra as for example shown in FIG. 15A. However, it is envisaged by the inventor that the methods and breast cup assembly 1 defined by the methods of the present invention may be incorporated in a strapless bra and certainly the configuration of the perimeter of the breast cup assembly is not to be considered limited to those shown in the accompanying drawings. It is also envisaged that the breast cup assembly may be incorporated as part of a different kind of garment of clothing such as for example, lingerie, swimwear or a female dress in general. Accordingly whilst in the most preferred form reference will herein be made to a breast cup assembly particularly for its application as part of a bra, it is to be appreciated that the breast cup assembly need not necessarily be provided for the purposes of defining a component in underwear. The breast cup assembly may indeed be incorporated into a garment which is outerwear.

Figure 14:
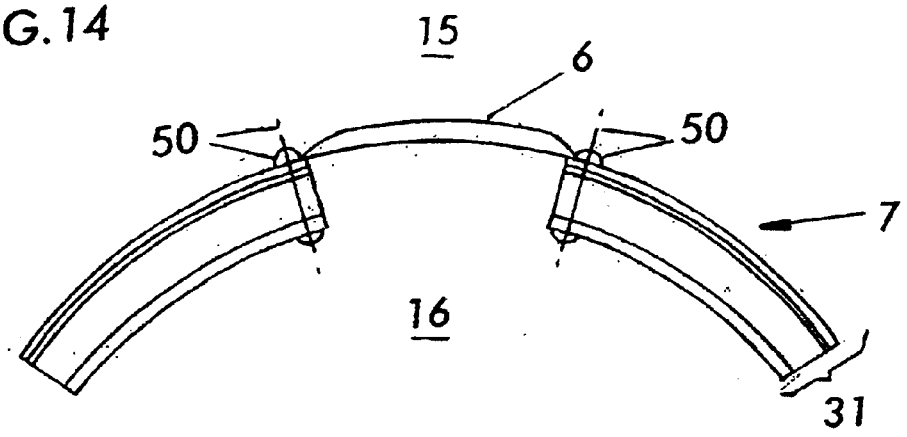

The breast cup assembly 1 as shown in FIG. 15 includes a panel 6 of contrasting appearance to the general cup defining panel assembly 7 of the breast cup assembly 1. The panel of contrasting appearance 6 may be a panel of different material and may be of a single ply or of a multi-ply. With reference to FIG. 14 which is a sectional view through part of the breast cup assembly of FIG. 15, it can be seen that the panel of contrasting appearance 6 is exposed on the convex side 15 and the concave side 16 of the breast cup assembly. A panel 6 which is made of a multi-ply construction may expose to the convex side a material of one colour or texture and to the concave side a material of another colour or texture. However, in the most preferred form the panel 6 is a panel of lace material. The lace material will have a partially see through effect and provides a decorative effect to the convex side 15 of the breast cup assembly. The configuration as shown in FIG. 14 where part of the generally cup defining panel assembly 7 is removed, the see through effect of the lace material can be enhanced particularly when a bra incorporating the breast cup assembly of the present invention is being worn, when the colour of the skin will be exposed in regions through the lace material.

The preferred form of constructing the breast cup of FIG. 15 will now be described with reference to the drawings.

FIG. 1 illustrates a sheet 10 of flexible and moldable material which is used to define the structure defining component 31 to the breast cup assembly 1. A sheet 10 is of a perimeter size sufficient for at least one cup form to be molded therein. In the most preferred form the sheet is of a perimeter sufficient to allow for two matching cup forms (left and right side) to be formed in the sheet simultaneously by a two cup molding machine, as for example shown in part in FIG. 2. The sheet 10 preferably consists of three layers of material. The first layer 11 is a sheet layer of foam 11 such as, for example polyurethane. In its pre-molded form, the sheet of foam 11 is for example of a thickness of 5 mm. The sheet of foam 11 has engaged to each of its opposed major surfaces, layers of thin flexible sheet such as a fabric material 12, 13. The layers of fabric material 12, 13 are adhered preferably directly to the opposing major surfaces of the sheet of foam 11. Such adhesion may be by heat welding and/or adhesive affixing. The sheet 10 is preferably cut from a bulk supply of material to define the sheet and accordingly the fabric layers 12, 13 are substantially co-extensive with the sheet of foam 11. The layers of fabric 12, 13 are preferably of a woven fabric, however alternatively the layers 12, 13 are of a non-woven kind. All plies of the sheet 10 are of a synthetic and moldable material.

In an alternative form of the sheet 10 of FIG. 1, a fabric layer may be applied only to one major surface of the sheet of foam 11. Whilst such a form is less desirable it is envisaged that the breast cup assembly 1 and the methods of forming the breast cup assembly 1 may utilise such a single side fabric covered sheet of foam assembly. Reference will briefly be made to such an alternative form hereinafter as the methods of construction of the present invention are described.

The sheet 10 has a molded cup form or forms introduced therein by a molding device as, for example, in part shown in FIG. 2. The molding device includes an upper mold portion 17 and a lower mold portion 18. It can be seen in the arrangement of FIG. 2 that the upper mold portion includes convex molding surfaces and the lower mold portion includes substantially complimentary shaped concave molding surfaces to introduce two, three dimensional cup forms into the sheet 10 of the FIG. 1.

Preferably although not essentially, the molding step to define the molded cup form(s) in the sheet 10 of FIG. 1 also includes the provision of an embossed or depressed relief to the concave side of the molded cup form(s). Such embossing is preferably provided by an upstanding region 19 of at least one of the convex cup molding surfaces of the upper mold 17.

Preferably where both cups to be incorporated into the bra are to include the panel 6 as shown in FIG. 15 then both convex up stands of the upper mold portion should include the upstanding surface 19. Since the panel 6 is to be incorporated into the cup form within the boundaries 2, 3, 4 of the perimeter of the cup, the embossing defining upstanding portion 19 provide an embossed region which preferably defines an enclosed region to the concave side of the cup shapes formed in the sheet 10.

With reference to FIG. 3, the embossed region 20 is defined by the molding device within the perimeter defined by edges 2, 3 and 4 of the cup forms of the sheet 10. In the examples shown in FIG. 3, the embossing is of a track like form which defines the perimeter to the region 22 bounded by the embossing. Such a track form is for example, able to be defined by an upstanding track like region 19 of the upper mold 17 as shown in FIG. 4.

Figure 9:
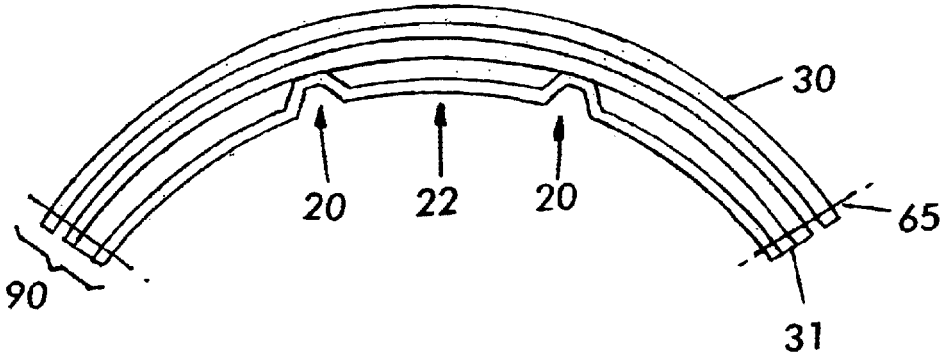

In an alternative form the entire region 22 is embossed or depressed and such may be provided by an upstanding region which is entirely upstanding from the cup defining surface 25 of the upper mold portion 17. In effect the embossing step reduces the thickness of the panel 10 by compressing the sheet 10 and in particular the foam 11 of the sheet at regions of embossing to an extent greater than the remaining regions of the sheet 10 within the molded breast cup form. The embossed relief is for example shown in FIG. 9. The provision of the embossed relief to the concave side of the breast cup form of the sheet 10 is not essential but is preferred for the purposes of allowing for duplicated and repeatable placement of the panel 6 with the convex side of the cup form. The purposes of the embossing to allow for such consistent placement will become apparent as the steps to the method are further explained.

Figure 8:
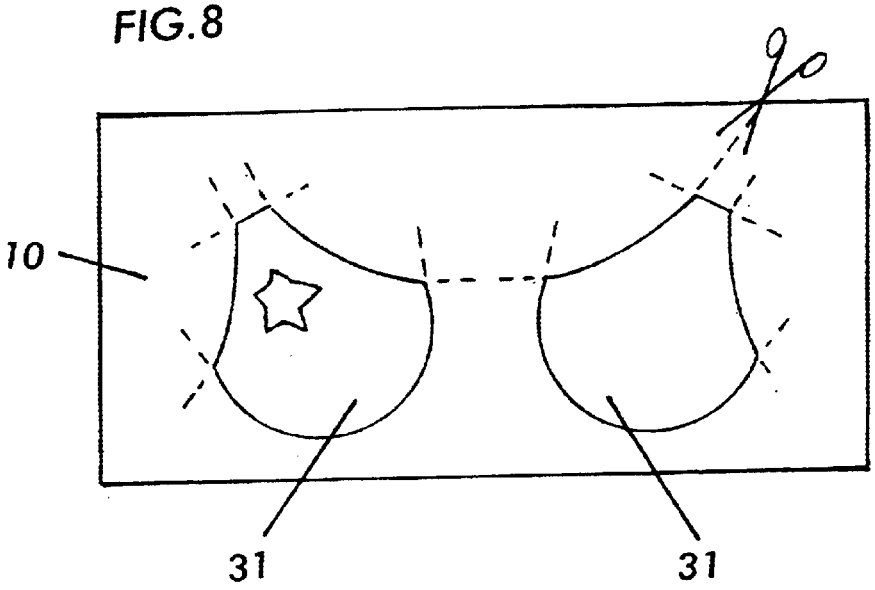

Once the cup form(s) are molded in the sheet 10 the cup form(s) may be cut from the remainder of the sheet 10 as for example shown in FIG. 8.

In the most preferred form the cup forms are cut from the remainder of the sheet 10 prior to the engagement of a covering panel 30 to the structure defining component 31 of the cup forms defined from the then molded sheet 10. However it maybe possible to engage the covering panel 30 to the structure defining component 31 whilst still engaged to the remainder of the foam sheet 10. However, preferably the covering panel 30 is engaged to the structure defining component 31 once the structure defining components are removed from the remainder of the sheet 10.

The covering panel 30 is preferably disposed from the convex side of the structure defining component 31. The cover panel 30 is preferably defined from a sheet of moldable flexible material as for example shown in FIG. 5. The flexible sheet 30 is preferably of a single ply material such as a fabric material. It is preferably made from a synthetic material such as a nylon/lycra® spandex blend of 86% nylon and 14% lycra® spandex.

In order to ensure that the covering panel (covering fabric) 30 can conveniently conform to the three dimensional cup shape of the structure defining component 31, the covering fabric 35 is preferably molded to a three dimensional cup form substantially commensurate with the three dimensional cup form of the structure defining component 31 to which it is to be engaged. The covering fabric may for example be molded in a molding device as for example in part shown in FIG. 6, the device providing two molded cup forms into a single sheet of covering fabric 35. For the purposes of such molding step the fabric sheet 35 may need to be engaged with a frame 36 which will hold the perimeter of the fabric sheet 35 in position during the molding process to prevent the fabric sheet 35 from wrinkling during the molding step.

Figure 18:
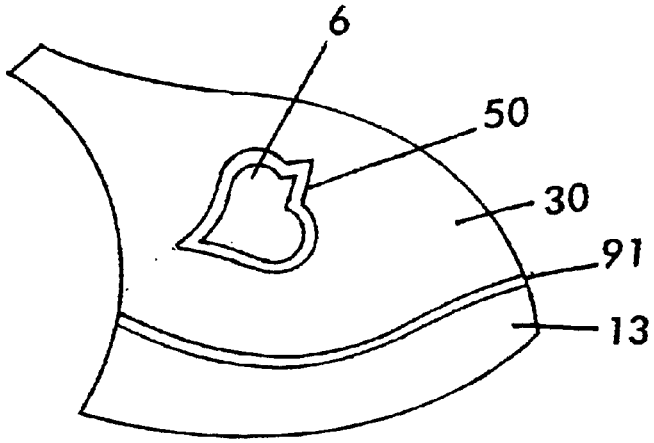
FIG. 18 is an alternative to the breast cup assembly of FIG. 15.

The cup forms defined in the fabric sheet 35 may then be applied to the convex side of the structure defining component 31 and affixed thereto. It may cover the entire convex side or part of the convex side (see FIG. 18). Such a fixing may be achieved in one of several manners the details of which will be hereinafter described.

The cup forms formed in the fabric sheet 35 may be cut prior to being affixed to the structure defining component 31 or after.

The purpose of affixing the covering fabric 30 to the structure defining component 31 is to ensure that they remain in register together.

In the version of the method of the present invention where the embossing step is provided, the embossing is effectively provided for the purposes of aiding the positioning of the panel 6 in a repeatable manner with the structure defining component and cover fabric assembly (hereinafter the "panel assembly 90").

Figure 10:
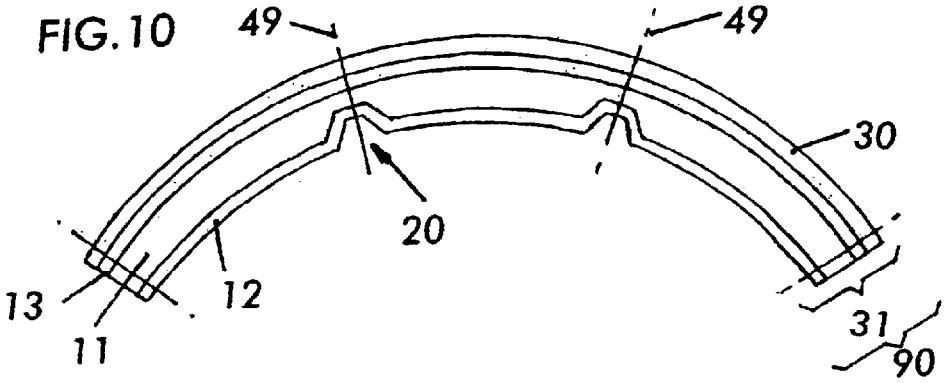

The purpose of providing the embossed region on the concave side of the structure defining component 31 is to allow for a means of reference to be generated on the convex side of the panel assembly which will allow for the placement of the panel 6 to be positioned in the desired position. The way in which the reference is provided to the convex side is preferably by stitching panel 6 to the panel assembly 90 as shown in FIG. 10 together along the perimeter to the bounded area 22, bounded by the embossed region 20. Such stitching 49 is preferably applied by the use of a sewing machine which can apply a straight line stitching following the outer perimeter of the embossed relief, in the concave side of the panel assembly.

A sewing machine operator can manipulate the assembly of panels to position this relative to the sewing machine to provide stitching through the panel assembly 90 along the perimeter of the embossed region 20. Such stitching will penetrate through all of the panels and will present a line of stitching 49 exposed to the convex side of the panel assembly 90. A panel 6 is preferably cut to a shape matching the shape of the line of stitching can then be positioned against the convex side of the assembly, its position gaining reference from the line of stitching visible 49 to the convex side of the panel assembly 90 to thereby accurately position the panel 6 in the desired location.

Whilst in the preferred form such stitching 49 is provided through the layers of the panel assembly 90 to define an enclosed region which proximately corresponds to the enclosed region 22 defined by the embossing on the concave side, it will be appreciated that since the primary purpose of providing the stitching is to provide reference points to the convex side such stitching need not be continuous. Indeed it is envisaged by the inventor that the stitching may provide two reference points visible from the convex side. Such two reference points can be sufficient to allow for the correct positioning of the panel 6 in the desired location against the convex side of the panel assembly 90.

In an alternative form of the present invention however the embossing may not be provided for the purposes of generating the cup assembly 1 of FIG. 15. It may be that approximate positioning by line of sight by the operator of a sewing machine may be sufficient to generate a desired result. However for mass production the repeatability of positioning is preferred and accordingly the embossing and stitch through steps to define the reference stitching 49 is preferred. It is however anticipated by the inventor that alternative forms of defining a reference point on the convex side of the panel assembly is achievable. However, it is most preferred that any means for defining the reference points are introduced at the molding steps and not on the perform sheet 10. This is because during the molding step movement of the material as a result of the molding may not be predictable. Accordingly any screen printing or other marking provided on a surface of the sheet 10 may not end in a repeatable position on the cup form once the sheet has been rolled. Accordingly it is believed by the inventor to be most reliable to introduce a means for defining the reference (i.e.; the embossing) during the molding phase.

The affixing of the panel 6 to the convex side 15 of the assembly is preferably also achieved by stitching. Such stitching 50 is preferably at and about the entire perimeter of the panel 6 as, for example, shown in FIG. 11. Since this stitching 50 is going to be a visible part of the final construction of the breast cup assembly and the brassiere incorporating such, the stitching 50 is preferably of an aesthetic kind such as, for example, of an embroidered or overlooking kind. The embroidered type of stitching that is preferably utilised for the stitching 50 is of a kind which defines a beaded like line of stitching. Such stitching will extend to the perimeter of the panel 6 and cover the perimeter of the panel 6 so that the perimeter of the panel 6 will be captured within the embroidered like stitching and not be visible. Such is for example, shown in FIG. 14. The stitching 50 may however be of a different kind or may not be of a final finishing kind and reference to the stitching 50 will hereinafter be again referred to once some further aspects of the invention have been described.

In the most preferred form and as has so far been described, the panel 6 is preferably affixed to the convex side of the panel assembly 90. Such is desirable as, once incorporated, the panel 6 will have the appearance of being substantially at the convex surface of the cup assembly. However in an alternative form the panel 6 may be affixed to the concave side of the assembly. In such an example the panel 6 is provided to the concave side. If reference points for the positioning of such panel are to be provided, the steps of embossing may need to be provided to the convex side.

Figure 11:
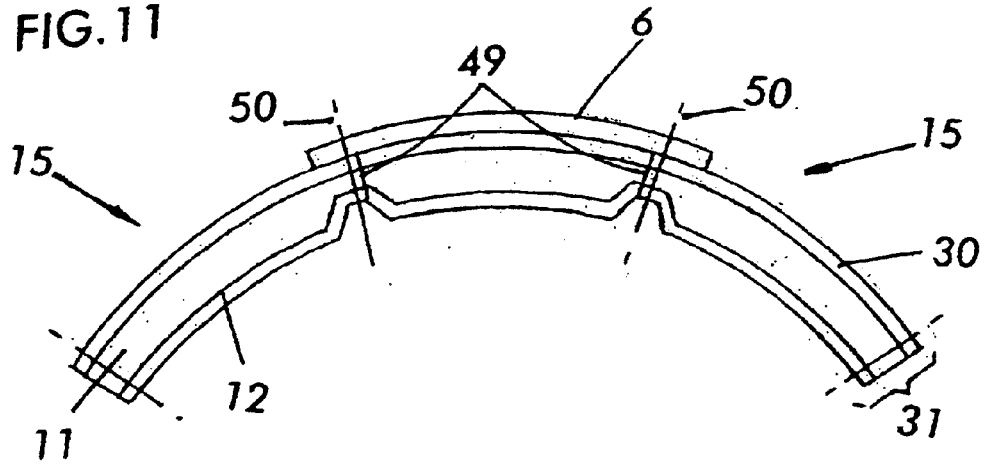
Figure 12:
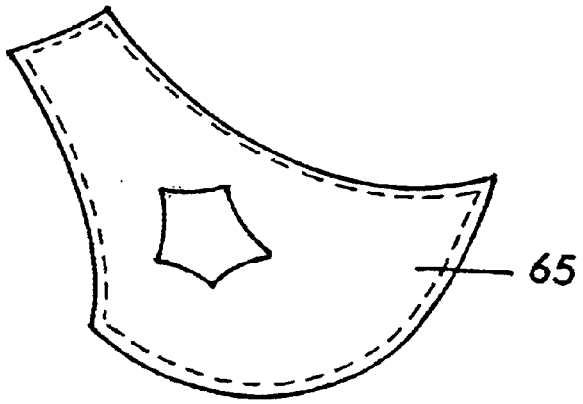

With reference to FIG. 11, it can be seen that the structure defining component 31 defined from the panel 10 is of an alternative kind wherein only a single layer of fabric material 12 is provided to the foam panel 11. Whilst it is envisaged that this is one form of construction of the assembly of the present invention it is less desirable since the foam may be subjected to weathering wherein its colour may vary from the colour at manufacture. In particular foam has a tendency to "yellow" and should the covering fabric 30 not be of a construction which may prevent such yellowing and prevent such yellowing from being visible from the convex side of the cup construction, the discolouring of the foam will be an undesirable effect to the appearance of the final breast cup assembly.

Accordingly the most preferred form is where the foam has a fabric panel on both sides and in particular so as to provide a two layer panel assembly to the convex side of the cup construction.

As an alternative the covering fabric may be absent from the panel assembly and the breast cup assembly may only include the structure defining component formed from the sheet 10 without another layer provided external thereof. The panel 6 may then be affixed direct to the layer 13 of the structure defining component. A variation to this is where the panel is affixed to the fabric panel 12 on the concave side. The structure defining component is then cut to create the opening to expose the panel 6 to the other side.

Once the assembly as for example shown in FIG. 11 has been defined, material to the concave side of the panel 6 may be removed so as to provide a single panel thickness through this area. The fabric layer 12, the foam layer 11, the optional fabric layer 13 and the covering fabric 30 are removed within the region bounded by the perimeter of the panel 6 and intermediate of the stitching 50 about the panel 6. In the example and in the preferred form where the panel 6 is of a lace material such removal of the layers will expose the lace to the concave side of the construction which will have an enhanced and more desirable visual effect. Such an effect will be provided by a partial see through from the convex side to the concave side and when the breast cup assembly 1 incorporated with a brassiere is worn against the skin of a person, the skin of the person will be visible in part through the panel 6. Where the panel 6 is affixed to the concave side of the assembly the same material removed for the preferred configuration of FIG. 11 may occur, however such removal is achieved from the convex side.

In the configuration of FIG. 11 the material is removed by cutting the material away from the concave side of the panel assembly 90.

As can be seen with reference to FIG. 15 the panel 6 is provided within the bounds of the cup construction (boundaries 2, 3 and 4). The panel is bounded by stitching 50 which retains the panel 6 to the main body 7 of the cup construction. The cutting away of the material may be achieved by the use of scissors. Such cutting may be along the regions of the assembly within the bounds of the stitching 50 and such cutting may be assisted by it being along part of the embossed region 20.

Once the material has been removed, edges of the material will be exposed and such is visually appealing. Accordingly a second line of stitching is introduced to capture within the bounds of the stitching, the edges of the exposed plies of material resulting from the cutting away of the section as described above. The stitching is preferably along the line of stitching 50 and is preferably of an embroided kind so that it will capture within its bounds, the edges of the cut away fabric. Accordingly two sets of stitching may be provided along the line of stitching 50 shown in the drawings. The first line of stitching being to attach the panel 6 to the panel assembly 90 and the second provided for the purposes of capturing the edges exposed by the cutaway sections.

Figure 13:
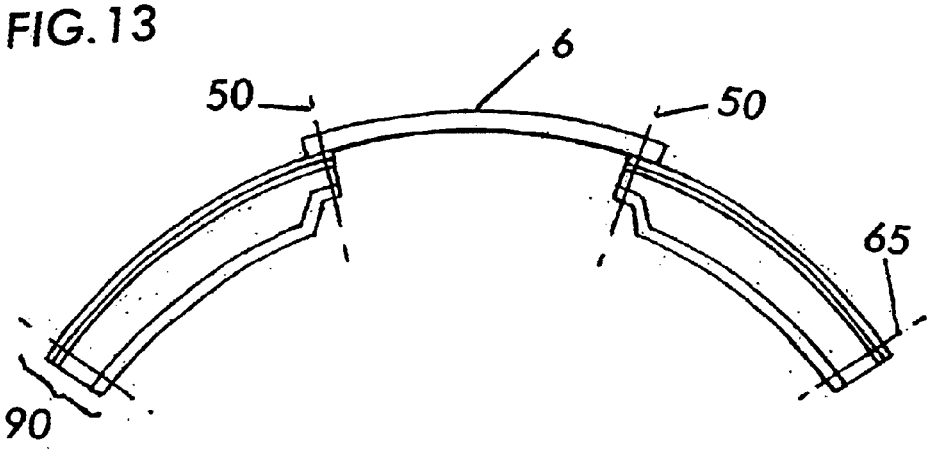
Figure 15A:
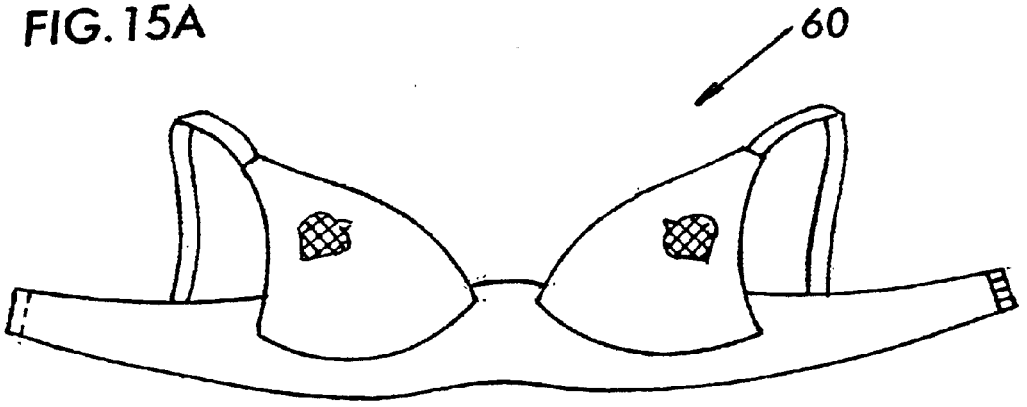

The assembly in the condition as for example shown with reference to FIGS. 13 and 15, can then be incorporated with other components to define a brassiere 60 as for example shown in FIG. 15A.

The covering fabric 30 is preferably engaged to the components of the sheet 10 by perimeter stitching 65. However in addition to such stitching to affix the covering fabric adhesive may be applied between the covering fabric and the structure defining component 31. Such adhesive may be applied everywhere save for the region of the assembly where the material is to be cut away to expose the panel 6 to the concave side of the cup construction.

In order to create a cup assembly which is aesthetically appealing, the covering fabric 30 is engaged to the structure defining component 31 in a manner to provide blind stitching at least along the neckline perimeter 2.

Figure 16:
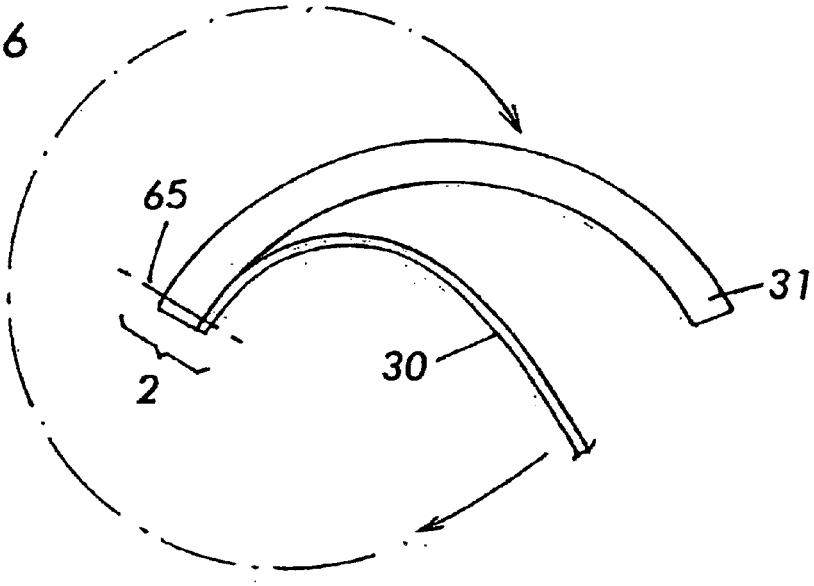
FIG. 16 is a sectional view of the structure defining component of the breast cup assembly engaged with the covering sheet prior to being manipulated to define the preferred relationship between the structure defining component and the covering sheet.
Figure 17:
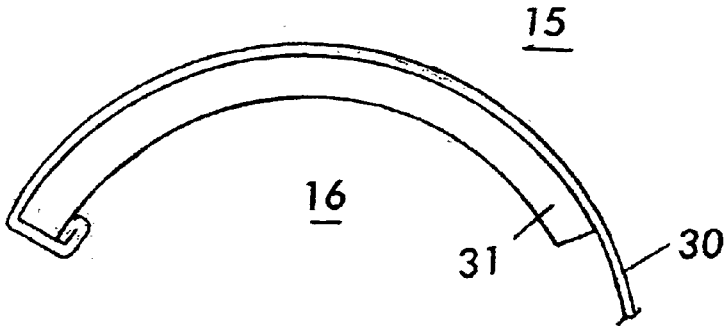
FIG. 17 is a sectional view wherein the cover sheet and the structure defining component of FIG. 16 have been manipulated to define the preferred form of their relationship which will lead to the constructional relationship as shown in FIG. 9.

With reference to FIGS. 16 and 17 such blind stitching may be achieved by the engagement of the covering fabric 30 with the structure defining component 31 along the perimeter 2 by reversing the covering fabric 30 from the side it is affixed to of the structure defining component 31 to the convex side. A blind stitching configuration will then be provided along the perimeter 2. Since this perimeter 2 will be that part of the breast cup construction which will be a substantially free edge and may be more exposed to be seen than the other edges e, it is desirable for such blind stitching to be provided at this edge. It may however be feasible for such blind stitching to also be provided along the perimeter edge 4.

The molding the sheet 10 in the molding device of FIG. 2 may for example occur where the upper mold is of approximately 101° C. and the lower mold is approximately under 95° C. The molding time for such temperatures and the preferred materials will be for a period of about 120 seconds. The molding of the fabric panel 35 preferably occurs where the temperatures of the upper mold is approximately 208° C. and the lower mold is 215° C. The molding or dwell time is approximately 80 seconds.

An alternative to the method of constructing the cup assembly of the present invention will now be described. Such an alternative is not an alternative to all the steps but to part of the process of affixing the panel 66 with the covering fabric 30. It is anticipated that the provision of the panel 6 to the panel assembly 90 may occur at a step prior to the covering fabric 30 being engaged to the structure defining component 31. The panel 6 may be affixed to the covering fabric 30 pre or post molding of the fabric sheet 35 to define the covering fabric 30. The panel 6 may be affixed to the fabric sheet 35 by sewing subsequent to which the assembly is placed in a molding device to define the covering fabric with the panel engaged thereto. However such may create difficulties with respect to the position of the panel 6 and the maintaining of the structural integrity of the fabric sheet 35 to define the covering fabric 30. Since the covering fabric 30 is of a thin material the provision of the panel 6 to the covering fabric after molding but prior to its engagement with the structured defining component may also not be sufficient to allow for convenient engagement thereto of the panel 6. However since it is anticipated that such a step in the process of the provision of the cup assembly maybe achievable, the methods of the present invention includes this alternative step to the construction of the cup assembly.

The covering fabric 30 is preferably provided coextensive with the structure defining component 31. However with reference to FIG. 18 it can be seen that the covering fabric 30 may not be coextensive with the structure defining component and there may be a seam of embroided stitching 91 extending between the edge of the covering fabric 30 and the upper surface 13 of the structure defining component 31. In such a configuration, the covering fabric 30 is however provided to the structure defining component where the panel 6 is to be provided. Panel 6 will hence be captured also within the boundaries of the fabric panel 30. Whilst reference is made to the provision of a decorative panel 6 to the breast cup, it is envisaged that more than one discrete panel 6 may be provided to each cup assembly.

What is claimed is:

1. A method of making a breast cup for a garment of clothing comprising:— a) providing a structure defining component of a breast cup form and created from a flexible sheet of moldable material, wherein the breast cup form has a convex side and a perimeter;

b) providing a flexible covering panel of an at least part breast cup form wherein the at least part breast form corresponds to at least part of the structure defining component, engaging the flexible covering panel to the structure defining component to locate the covering panel on the convex side of the breast cup form of the structure defining component in at least a partial overlapping condition, to thereby define a panel assembly which includes the structure defining component and the covering panel, the panel assembly having a perimeter a concave side and an opposite convex side, c) affixing to the convex side of the panel assembly, a flexible decorative panel of a material of a contrasting appearance to the appearance of the convex side of the covering panel and in an overlying condition to part of the panel assembly and in a first position to locate the decorative panel inwardly of the perimeter of the panel assembly, the decorative panel having a perimeter, d) removing a region of the panel assembly covered by and within the perimeter of the decorative panel to thereby expose the decorative panel to the concave side of the panel assembly.

2. A method as claimed in claim 1 wherein the decorative panel has a respective second perimeter; the affixing defined in step (c) is by affixing the decorative panel at the second perimeter thereof to the panel assembly at and about the second perimeter of the decorative panel and wherein the removing defined in step (d) is removal of a region of the panel assembly encompassed by the perimeter which fixes the decorative panel.

3. A method as claimed in claim 1 wherein the affixing defined in step (c) is by stiching the decorative panel at the second perimeter thereof to the panel assembly at and about the second perimeter of the decorative panel and wherein the the removing defined in step (d) is removal of a region encompassed by the stitching at the second perimeter of the decorative panel.

4. A method as claimed in claim 1 wherein the structure defining component includes a means defining a visible reference point within the perimeter of the breast cup form wherein subsequent to step (b) and prior to step (c), relying upon the reference point to generate a visible reference point of corresponding position visible from the convex side of the panel assembly for the purposes of reliance in step (c) to establish an appropriate the first position of the decorative panel with respect to the panel assembly.

5. A method as claimed in claim 4 wherein the visible reference point on the convex side of the panel assembly is generated by penetrating the panel assembly from the concave side of the panel assembly to the convex side of the panel assembly with means defining a visible reference point.

6. A method as claimed in claim 5 wherein the penetrating is by stitching a line of thread through the panel assembly.

7. A method as claimed in claim 6 wherein the means defining a visible reference point is a line of reference, the stitching being along at least part of such the line of reference.

8. A method as claimed in claim 6 wherein the means defining a visible reference point is an endless line of reference provided about a region of the panel assembly, the stitching being along the endless line, the region being of a perimeter shape commensurate with a shape of the second perimeter of the decorative panel to thereby allow the decorative panel to be aligned with the stitching and subsequently affixing as defined in step (c).

9. A method as claimed in claim 4 further comprising forming of the structure prior to step (a), and wherein the means defining a visible reference point is generated during the forming of the structure defining component prior to step (a).

10. A method as claimed in claim 4 further comprising forming of the structure prior to step (a), and wherein the means defining a visible reference point is generated during the forming of the structure defining component prior to step (a) by embossing the visible reference point into the convex side of the breast form of the structure defining component.

11. A method as claimed in claim 10 wherein the structure defining component includes a sheet of foam material and the embossing is achieved by compression of the sheet of foam material so that the visible reference point is defined during the forming of the structure defining component.

12. A method as claimed in claim 4 wherein the moldable material of the structure defining component includes at least one sheet of foam material and the covering material comprises a sheet of fabric material adhered to at least one major surface of the foam material, the engaging of the structure defining component with the covering panel being to position the covering panel on a side of the structure defining component opposite to the at least one sheet of fabric material.

13. A method as claimed in claim 1 wherein subsequent to step (d) applying embroidery stitching at or proximate and inward of the perimeter of the decorative panel to capture, within an enclosure defined by the embroidery stitching, edges of the panel assembly that are exposed by the removing of the region defined as step (d).

14. A method as claimed in claim 13 wherein the decorative panel has a perimeter edge and the embroidery stitching also captures within the enclosure defined by the embroidery stitching the perimeter edge of said decorative panel.

15. A method as claimed in claim 1 wherein the covering panel has a perimeter and the engaging defined in step (b) is by affixing by sewing of the covering panel to the structure defining component at the perimeter of the covering panel.

16. A method as claimed in claim 1 wherein where the covering panel is of coextensive perimeter shape to the structure defining component, the engaging defined in step (b) is by affixing by sewing of the covering panel to the structure defining component at the perimeter of the structure defining component.

17. A method of making a breast cup for a garment of clothing comprising:— a) providing a structure defining component of a breast cup form and created from a flexible sheet of moldable material, b) engaging a flexible covering panel, of an at least part breast cup form corresponding to at least part of the structure defining component, to the structure defining component to locate the covering panel on the convex side of the breast cup form of the structure defining component in at least a partial overlapping condition, to define a panel assembly which includes the structure defining component and the covering panel, wherein the panel assembly has a convex side, a concave side and a perimeter;

c) affixing to the concave side of the panel assembly, a decorative panel of flexible decorative panel material of a contrasting appearance to the convex side of the covering panel, in an overlying condition to part of the panel assembly and in a position to locate the decorative panel inwardly of the perimeter of the panel assembly, the decorative panel having a perimeter;

d) removing a region of the panel assembly covered by and within the perimeter of the decorative panel to thereby expose the decorative panel to the convex side of the panel assembly.

18. A breast cup assembly for incorporation into a garment of clothing and made in accordance with the method of claim 1.

19. A breast cup assembly comprising a structure defining component of a breast cup form and created from a flexible sheet of moldable material, the structure defining component having a convex side;

a flexible covering panel affixed to the structure defining component and of an at least part breast cup form corresponding to at least part of the structure defining component, the covering panel located adjacent the structure defining component on the convex side of the structure defining component and in an at least a partial overlapping condition with the structure defining component, to define a panel assembly which includes the structure defining component and the covering panel, the panel assembly having a convex side, a concave side and a perimeter;

a decorative panel of flexible material of a contrasting appearance to the convex side of the panel assembly and affixed, at either one side selected from the convex side and concave side, to the panel assembly in an overlying condition and located in a position inwardly of the perimeter of the panel assembly, the decorative panel having a perimeter;

wherein an opening is provided through the structure defining component at a region of the structure defining component encompassed by the perimeter of the decorative panel to there through expose the decorative panel to the opposite of the one of the convex side and the concave side of the structure defining component.

20. A breast cup assembly as claimed in claim 19 wherein the structure defining component includes a molded sheet of foam material.

21. A breast cup assembly as claimed in claim 19 wherein the structure defining component includes molded sheet of foam material having opposed major surfaces and there is affixed to each opposed major surface of the molded sheet a panel of fabric.

22. A breast cup assembly as claimed in claim 19 wherein the decorative panel is affixed to the convex side of the panel assembly by stitching extending through the decorative panel and the panel assembly and provided at or immediately inwardly of the perimeter of the decorative panel and wherein the stitching at the perimeter of the decorative panel is an embroidery and captures within the stitching the perimeter edge of the decorative panel.

23. A breast cup assembly as claimed in claim 19 wherein the structure defining component and the covering panel are coextensive.

24. A breast cup assembly as claimed in claim 19 wherein the covering panel is a flexible fabric material.

25. A breast cup assembly as claimed in claim 19 wherein the decorative panel is a lace material.

26. A breast cup assembly as claimed in claim 19 wherein the structure defining component and the covering panel are coextensive and are stitched to each other at the perimeter of the cup form and at where the perimeter of the decorative panel is affixed to the panel assembly.

27. A method of making a breast cup for a garment of clothing comprising:— a) providing a structure defining component of a breast cup form and created from a flexible sheet of moldable material, and the structure defining component having a convex side, a concave side and a perimeter;

b) affixing at a convex side region and in an overlying condition to the structure defining component, a decorative panel of flexible material of a contrasting appearance to the convex side of the structure defining component, the affixing being at a position to locate the decorative panel inwardly of the perimeter of the structure defining component, the decorative panel having a perimeter;

c) removing a region of the structure defining component to create an opening through the structure defining component, the opening being at a region corresponding to and inwardly of the perimeter of the decorative panel to thereby expose the affixed decorative panel to the concave side of the structure defining component.

28. A method as claimed in claim 27 wherein the affixing defined in step (b) is or includes affixing of at least part of the perimeter of the decorative panel to the structure defining component, the removing to create the opening comprising cutting the structure defining component at a region inwardly of the perimeter of the decorative panel.

29. A method as claimed in claim 27 wherein the removing to create the opening in the region of the structure defining component is such that once the region is removed, the opening remains covered by the decorative panel.

30. A method as claimed in claim 27 wherein prior to the affixing in step (b), a flexible covering panel, of an at least part breast cup form and corresponding to at least part of the structure defining component, is engaged to the structure defining component to locate the flexible covering panel on the convex side of the breast cup form of the structure defining component in at least a partial overlapping condition with the convex side of the structure defining component, whereby the flexible covering forms part of the structure defining component.

31. A method of making a breast cup for a garment of clothing comprising:— a) providing a structure defining component of a breast cup form and created from a flexible sheet of mouldable material and having a convex side, a concave side and a perimeter, b) affixing at the concave side, in an overlying condition to the structure defining component, a decorative panel of a flexible material having a contrasting appearance to the convex side of the structure defining component, the affixing being at a position to locate the decorative panel inwardly of the perimeter of the structure defining component, the decorative panel having a perimeter;

c) removing a region of the structure defining component to create an opening through the structure defining component, the opening being inwardly of the perimeter of the decorative panel to thereby expose the affixed decorative panel to the convex side of the panel assembly.

32. A method as claimed in claim 31 wherein the affixing described in step (b) is or includes affixing of at least part of the perimeter of the decorative panel with to the structure defining component, and the removing to create the opening being by cutting the structure defining component at a region corresponding to and being inwardly of the perimeter of the decorative panel.

33. A method as claimed in claim 31 wherein the removing to create the opening in a region of the structure defining component is such that once the region is removed, the opening remains covered by the decorative panel.

34. A method as claimed in claim 31 wherein a flexible covering panel of an at least part breast cup form and corresponding to at least part of the structure defining component, is engaged to the structure defining component to locate the flexible covering panel on the convex side of the breast cup form of the structure defining component in at least a partial overlapping condition with the convex side surface of the structure defining component, the flexible covering thereby forming part of the structure defining component.

35. A method as claimed in claim 34 wherein the decorative covering panel is affixed prior to the step (b).

36. A breast cup assembly comprising a structure defining component of a breast cup form and created from a flexible sheet of moldable material and having a convex side, a concave side and a perimeter;

a decorative panel of a flexible material having a contrasting appearance to the convex side of the structure defining component and affixed at either one side selected from said convex side and concave side of the structure defining component in an overlying condition and located in a position inwardly of the perimeter of the structure defining component, the decorative panel having a perimeter;

an opening through the structure defining component at a region of the structure defining component encompassed by the perimeter of the decorative panel to there through expose the decorative panel to the opposite of the one of the convex side and the concave side of the structure defining component.

37. A breast cup assembly as claimed in claim 36 wherein the structure defining component includes a flexible covering ply of material disposed at the convex side of the structure defining component and against which the decorative panel is engaged.

38. A method of making a breast cup for a garment of clothing comprising:— a) providing a structure defining component of a breast cup form and created from a flexible sheet of moldable material and having a convex side, a concave side and a perimeter;

b) engaging a flexible covering panel of an at least part breast cup form, having a convex side and a perimeter corresponding to at least part of the structure defining component, to the structure defining component to locate the covering panel on the convex side of the breast cup form of the structure defining component in at least a partial overlapping condition, thereby defining a panel assembly which includes the structure defining component and the covering panel, the panel assembly having a concave side;

c) applying to the convex side of the covering panel a decorative panel of flexible material of a contrasting appearance to the convex side of the covering panel and positioning the decorative panel in an overlying condition to the covering panel and in a position to locate the decorative panel inwardly of the perimeter of the covering panel, d) removing a region of the panel assembly encompassed by the perimeter of the decorative panel to thereby expose the decorative panel to the concave side of the panel assembly.

39. A method of making a breast cup for a garment of clothing comprising:— a) providing a structure defining component of a breast cup form and created from a flexible sheet of moldable material, the breast cup form having a convex side, a concave side and a perimeter, b) engaging a flexible covering panel, of an at least part breast cup form corresponding to at least part of the structure defining component, to the structure defining component to locate the covering panel on the concave side of the breast cup form of the structure defining component in at least a partial overlapping condition, to thereby define a panel assembly which includes the structure defining component and the covering panel, each of the covering, panel and the panel assembly having a concave side and a perimeter, c) applying to the concave of the covering panel, a decorative panel of a flexible material of a contrasting appearance to the convex side of the structure defining component, and positioning the decorative panel in an overlying condition to the covering panel and in a position to locate the decorative panel inwardly of the perimeter of the covering panel, d) removing a region of the panel assembly encompassed by the perimeter of the decorative panel to thereby expose the decorative panel to the concave side of the panel assembly.

* * * * *